United States Patent [19]

Menger

[11] Patent Number: 4,608,058

[45] Date of Patent: Aug. 26, 1986

[54] STEAM SUPPLY SYSTEM FOR SUPERPOSED TURINE AND PROCESS CHAMBER, SUCH AS COAL GASIFICATION

[75] Inventor: William M. Menger, Houston, Tex.

[73] Assignee: Houston Industries, Incorporated, Houston, Tex.

[21] Appl. No.: 649,596

[22] Filed: Sep. 12, 1984

[51] Int. Cl.[4] ..... F01K 25/00; C10J 3/54

[52] U.S. Cl. ..... 48/73; 48/87; 48/197 R; 48/202; 110/229; 122/5; 60/648; 60/692

[58] Field of Search ..... 48/73, 87, 197 R, 202; 122/5; 110/229; 60/648, 692

[56] References Cited

U.S. PATENT DOCUMENTS

| | | | |
|---|---|---|---|
| 2,579,398 | 12/1951 | Roetheli . | |
| 2,644,745 | 7/1953 | Hemminger . | |
| 2,704,704 | 3/1955 | Ogorzaly . | |
| 2,965,463 | 12/1960 | Elliott . | |
| 3,482,697 | 12/1969 | Tremont et al. | 210/140 X |
| 3,715,195 | 2/1973 | Tassoney et al. . | |
| 3,818,869 | 6/1974 | Blaskowski . | |
| 3,841,100 | 10/1974 | Fortescue et al. . | |
| 3,870,480 | 3/1975 | Moss . | |
| 3,873,845 | 3/1975 | Osthaus . | |
| 3,912,464 | 10/1975 | Schultz . | |
| 3,916,617 | 11/1975 | McKenzie et al. . | |
| 3,951,615 | 4/1976 | Gernhardt et al. . | |
| 4,007,786 | 2/1977 | Schinger . | |
| 4,019,314 | 4/1977 | Springmann . | |
| 4,037,413 | 7/1977 | Heller et al. . | |
| 4,043,130 | 8/1977 | Brown et al. . | |
| 4,069,024 | 1/1978 | Fernandes . | |
| 4,074,981 | 2/1978 | Slater . | |
| 4,144,723 | 3/1979 | Morse . | |
| 4,181,504 | 1/1980 | Camacho . | |
| 4,202,406 | 5/1980 | Avery . | |
| 4,208,298 | 6/1980 | Irie et al. . | |
| 4,209,304 | 6/1980 | Kessler et al. . | |
| 4,231,226 | 11/1980 | Griepentrog . | |
| 4,275,562 | 6/1981 | Fejer . | |
| 4,278,445 | 7/1981 | Stickler et al. . | |
| 4,313,300 | 2/1982 | Wilkes et al. . | |
| 4,319,628 | 3/1982 | Hughes . | |
| 4,341,530 | 7/1982 | Loth et al. . | |
| 4,426,810 | 1/1984 | Rudolph et al. | 48/202 X |

FOREIGN PATENT DOCUMENTS

| | | | |
|---|---|---|---|
| 252158 | 9/1926 | United Kingdom | 60/67 |

*Primary Examiner*—Arthur Kellogg

*Attorney, Agent, or Firm*—Pravel, Gambrell, Hewitt & Kimball

[57] ABSTRACT

A steam supply system is provided for use in conjunction with both a superposed turbine driven by a steam boiler and a process chamber. The steam boiler operates at a pressure above that needed for consumption in the process chamber and uses highly purified water. The process chamber can use steam which has been generated from relatively low purity water and may be any steam consuming process, such as in one embodiment coal gasification, not requiring that the water be returned for re-use as steam. Energy remaining in the high purity steam after it leaves the superposed turbine is used in a condensing reboiler to heat the water into steam for the process chamber. The two fluids are kept essentially isolated from contact with each other in the condensing reboiler, and the high purity water is pumped back to the high pressure boiler in a closed loop system. The use of high purity water to produce high pressure steam provides protection to the superposed turbine from fouling and damage, thereby extending both its operating range and useful life.

10 Claims, 2 Drawing Figures

STEAM SUPPLY SYSTEM FOR SUPERPOSED TURINE AND PROCESS CHAMBER, SUCH AS COAL GASIFICATION

FIELD OF INVENTION

The present invention relates to supplying steam for coal gasification using superposed steam turbines for the generation of power.

BACKGROUND OF THE INVENTION

In processes which consume steam it is common practice to generate the steam in a boiler at a pressure higher than the pressure required by the process, and then to expand this steam through a turbine before injecting it into the process for use and consumption. The turbine performs useful work, typically driving an electrical generator. It is logical to consider that the cost of generating steam at the pressure required by the process is chargeable to the process; on this basis, the work done by the turbine is obtained for the additional cost of operating the boiler at the higher temperature and pressure which are required by the turbine, and this additional cost is normally small when compared with the value of the work done. The turbine is said to be superposed on the process, and superposed turbines are often attractive economically.

For a process which returns little or none of the condensed steam to the boiler, it is necessary to add fresh water to the boiler continuously. For low pressures, this causes no great problem. It is feasible to operate boilers at pressures up to 400 psi with water which has been taken from wells or streams and treated by comparatively inexpensive means. Unfortunately, however, increases in boiler pressure cause major increases in the stringency of the requirement for purity of boiler water. For chemical processes which are supplied with steam at 300 to 600 psi (or higher) from a superposed turbine, the boiler and turbine must operate at substantially higher pressures (typically 1000 to 1500 psi). Techniques are known for treating water sufficiently for satisfying the purity requirements of boilers operating at pressures in this general range. Between 1500 and 2000 psi this becomes even less practical as pressure is increased. For pressures 2000 psi and higher, however, chemical treatment of any large fraction of the quantity of water required by a given boiler is impractical physically in terms of size and quantities of materials as well as economically in terms of costs.

It is commonplace to operate boilers and turbines at sub-critical pressures as high as the general 2500 psi range, and even in the super-critical range of about 3500 psi; but such pressures have been restricted to processes which return substantially all of the steam in the form of high purity condensate for re-injection into the boiler. In such processes, the only necessary water treatment to high purity after the initial purified charge is the small quantity necessary to replace leakages and losses plus, in certain cases, a relatively simple treatment to reduce or eliminate impurities which find their way into the system. For this, the cost of treatment can be tolerated. However, it was infeasible to consume steam of this purity in another process although valuable energy remained in the steam on exit from the turbine.

Continuous processes for the production of gaseous fuel from a solid carbonaceous fuel are known, such as that in U.S. Pat. No. 4,074,981. Such processes require large quantities of steam for injection into the gasifier to serve as a reagent for the production of the gaseous fuel. In addition, steam entering the gasifier should be at a pressure of several hundred pounds per square inch, for example in the range of about 550 psi. Steam for this gasification process is typically produced in a boiler which is continuously fed by a stream of feedwater. However, feedwater purity requirements for the gasification process are considerably lower than those for steam turbine power generation at the same temperatures and pressures.

Previous attempts to efficiently combine coal gasification with steam turbine power generation have focused on utilizing waste heat from the gasification process, e.g. heat from reducing the temperature of product gas, for heating feedwater, for producing steam to drive steam turbines. Although acceptable for obtaining improvement in overall power plant efficiency, such methods have limitations. U.S. Pat. No. 3,873,845, for example, involves a process combining coal gasification with power generation in which waste heat from the gasification process is used to produce steam for power generation. The steam is produced from heat exchangers downstream from the gasification process. The waste heat produces steam at a pressure of 120 atmospheres and a temperature of 520° C. Although this utilization of heat generated by cooling the product gas affords some improvement in overall plant efficiency, it has limitations. For example, contamination of the steam turbine feedwater can occur in heat exchangers used for cooling the product gas. Such contamination can be detrimental to steam turbine elements.

U.S. Pat. No. 4,043,130 relates to a turbine generator cycle for provision of heat to an external heat load. A dual purpose power generation facility combines electric power generation with a brine desalinization process. The power plant of the generator facility includes a series of high pressure and low pressure steam turbines mechanically linked on a common shaft connected to an electrical generator element. Each of the turbines is connected to a heat exchanger where heat is extracted in the form of steam which is transferred to the desalinization process.

In this system, there is a closed loop arrangement for maintaining steam turbine feedwater in isolation from the desalinization feedwater. The system, however, is designed for operation at relatively low temperatures and pressures, where contamination is not a severe problem. Although acceptable for a process which requires steam at relatively low pressures, e.g. in the 25 psi range, the system is not suitable for steam consuming as opposed to heat consuming processes which require steam in the range of 300–600 psi or higher.

SUMMARY OF THE INVENTION

Briefly, the present invention relates to a steam supply system used with both a superposed turbine and a process chamber consuming steam when in use. The superposed turbine receives steam at high pressures, such as above those required for the process chamber, typically about 2000 psi, and drives an electrical generator or performs other useful work. The process chamber may be, for example, a coal gasification system which is supplied with relatively low pressure steam, such as below 600 psi, for consumption. The present invention extends the useful operating range of the superposed turbine by operating the boiler at higher pressures than required by the process chamber, extending from as low as 800 psi to above 2000 psi, typically 2400 psi to 3500 psi. At such a pressure range, extremely high degrees of water purity in the steam are necessary to prevent damage, primarily to the superposed turbine.

With the present invention, the boiler, its feed pump and the turbine are connected in a closed loop system with the high pressure side of a condensing reboiler. A low pressure side of the condensing reboiler receives amounts of water for consumption or use in the process chamber which may be of greatly lower purity than that for the superposed turbine. In the condensing reboiler, the two fluids are in heat exchange contact with each other but in fluid isolation from each other. This permits the heat remaining in the high purity steam leaving the turbine to be used in heating the low purity water to be consumed in the process chamber.

DETAILED DESCRIPTION OF A PREFERRED EMBODIMENT

Figure 1:
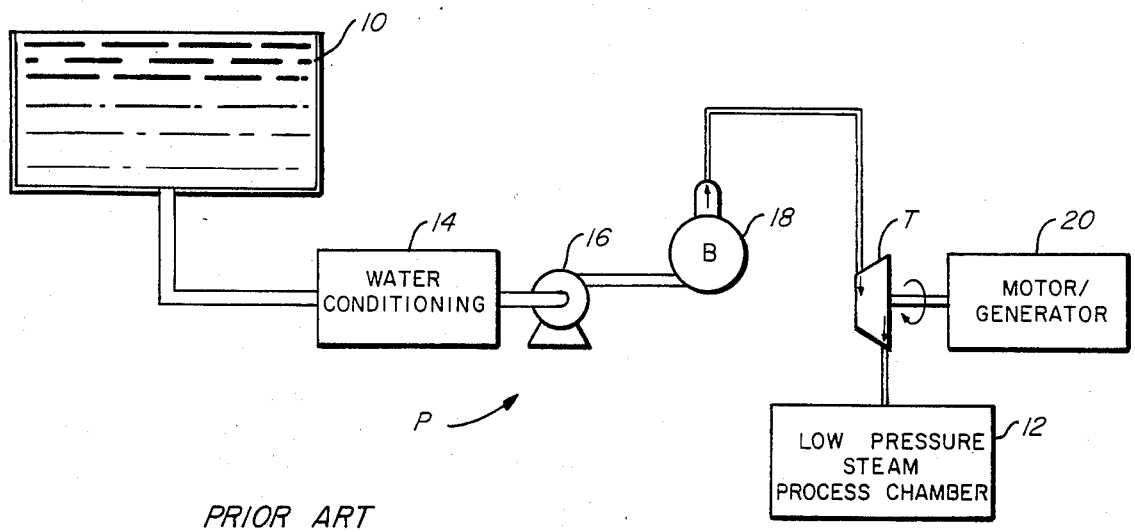
PRIOR ART FIG. 1
FIG. 1 is a schematic diagram of a prior art steam supply system.

At the outset, it is submitted to be beneficial for an understanding of the present invention to study a conventional prior art steam supply P (FIG. 1). In such a supply system, a source 10 of water is provided so that steam may be consumed in a process chamber 12. Suitable conventional pressure and temperature control and monitoring devices are provided at appropriate locations in the steam supply P. The steam is provided to the process chamber 12 at low pressure, due to the requirements of the process chamber. As an example, the process chamber 12 could be a coal or other carbonaceous fuel gasification system. It should be understood, however, that any other process which consumes relatively low pressure steam could be supplied with steam according to the particular needs of the process.

The steam in the process chamber 12 is substantially entirely consumed in the process and is not available for re-cycling or conversion again into steam. The particular operating pressure of the chamber 12 is determined by working conditions of the particular process selected. A water conditioning system 14 typically includes water softening when the required steam pressure does not exceed approximately 700 psi. Where the pressure ranges extend up to about 1800 psi, water purification is performed in the water conditioning system 14, either by demineralization or by evaporation. The water from the conditioning system 14 is passed by a boiler feed pump 16 to a boiler 18 where it is converted to steam in the desired pressure ranges. The steam leaving the boiler 18 is fed to the superposed turbine T which uses the energy in the steam to drive an electrical generator 20 or perform other useful work. The steam on passage through the turbine T is then passed to the process chamber 12 for consumption.

Prior to the present invention (FIG. 2), it was known that the superposed turbines could operate at much higher temperatures and pressures than that needed for use in the process chamber 12. However, at these higher pressures and temperatures, the superposed turbine T required extremely high purity water to prevent damage. It was undesirable to consume this quality of steam in the process chamber 12 due to the cost, size and capacity requirements of a suitable water treatment facility to obtain water of the purity required for operating the turbine T at the temperatures and pressures required.

With the present invention (Fig. 2), a high pressure boiler 30 operates at either sub-critical pressures, such as above about 2000 psi in the general 2500 psi range or even in a super-critical range up to about 3500 psi in a steam supply system S. Again, suitable conventional pressure and temperature control and monitoring apparatus are suitably located in the system S for process control purposes. The steam from boiler 30 at these high pressure ranges is provided to a superposed turbine T-1 which drives an electrical generator 32 or is used to drive some other mechanism providing useful work. The steam for the high pressure boiler 30 is formed from fluid furnished by a high pressure boiler feed pump 34. The fluid furnished from the boiler feed pump 34 to the boiler 30 is of very high purity to prevent damage of the turbine T-1. With the present invention, the steam leaving the turbine T-1 is provided to a high pressure side 36 of a condensing reboiler B.

It is to be noted that the boiler 30, pump 34 and turbine T-1 are connected into a closed loop fluid flow system by means of the high pressure side 36 of the condensing reboiler B according to the present invention. This closed loop permits the production of steam from substantially high purity water. After the loop in the system S of the present invention has received an initial purified charge of water of requisite purity, the only necessary water treatment to obtain high purity is a small quantity necessary to replace leakage and losses. If desired, in certain cases a relatively simple treatment may be given to water extracted from the closed loop and replaced to reduce or eliminate any impurities which might find their way into the loop system.

In addition to driving the superposed turbine T-1, the steam supply system S of the present invention provides water of relatively low purity at pressures needed for consumption in a process chamber 38, which may be similar to the process chamber 12 (FIG. 1). Water for the low pressure steam used in process chamber 38 comes from a source 40 through a water softening or purification system 42, of like structure and function to the water conditioning unit 14 (FIG. 1), and a condensing reboiler feed pump 44 through a low pressure side 46 of the condensing reboiler B. The relatively low purity water furnished the process chamber 38 from the low pressure side 46 of the condensing reboiler B is in heat exchange relation with the high purity steam in the high pressure side 36 of the condensing reboiler B. Thus, the heat remaining in the high purity steam after passing from the turbine T-1 is transferred to the low purity water, which is converted into steam in the condensing reboiler B and furnished to the process chamber 38. However, the different purity streams in the high pressure side 36 and low pressure side 46 of reboiler B are maintained separate and out of fluid contact from each other in the condensing reboiler B. There may be some slight degree of leakage between the high pressure side 36 and low pressure side 46 in reboiler B. However, for the purposes of the present invention, the streams may be regarded as essentially isolated.

In this manner, the system S of the present invention permits the superposed turbine T-1 to be driven to a much higher pressure and temperature at a relatively small increment of cost, while also permitting the superposed turbine T-1 to be used in conjunction with a supply of steam for consumption in the process chamber 38. This improves the efficiency and economy of the steam supply for the process chamber 38. It also accomplishes this result without the excessive expense of water treatment which has previously made such proposed use of superposed turbines impractical for continuous duty at such high pressures.

In certain applications the steam in low pressure or secondary side of condensing reboiler B may need to be superheated, while in others superheating is unnecessary. If superheating is required, it can be done in a separate superheater 50 using steam or fired by a fuel to produce the superheat. Superheating can also alternatively be provided from a superheater formed as an integral part of the condensing reboiler 46.

In the foregoing preferred embodiment, the boiler 30 is described as preferably operating at a pressure of about 2000 psi or above to drive the turbine T-1, since this range affords the greater economics of operating at higher pressures. It should also be understood that the present invention may be used with operating pressures in the range of 800 psi to 2000 psi in order to reduce the cost of boiler water treatment chemicals. Based on the reboiler and preheater costs as compared to water treatment equipment costs and the cost of water treatment chemicals, the present invention is also adapted for use with operating pressures between 800 psi and 2000 psi. Also, where economics are not controlling factors, the present invention may also be practiced at the 800 to 2000 psi pressure range, although less efficiently.

Although not shown in the drawings, it should be understood that heat exchangers may be provided between various fluid streams in the system of the present invention. For example, heat exchangers in FIG. 2 to heat water between water conditioning 42 and condensing reboiler 46, both before and after pump 44, would typically be included. These might be motivated by heat from the water flow from condensing reboiler 36 to boiler 30, both before and after pump 34. They might also be motivated by steam from any number of sources, or by hot gases from the process.

As an aid to understanding the advantages of the present invention, the following examples or cases are given. The base case (#1) is a boiler supplying only steam to a process chamber. The second case (shown in FIG. 1) is a conventional superposed turbine receiving steam from a boiler and exhausting to the same process chamber. The third case is according to the present invention (FIG. 2) applied to the same quantities of steam as the first two examples.

Case #1—Supplies steam only, 1,200,000 pounds/-hour of steam at 550 psia and 690° F.

Case #2—Supplies same steam as Case 1; in addition, generates 39,522 kw of electricity at 4015 Btu/kw-hour thermal efficiency.

Case #3—Supplies same steam as Cases 1 and 2; in addition, generates 67,687 kw of electricity at 4017 Btu/kw-hour thermal efficiency.

Because of the temperature level and thermal energy available in the steam exiting turbine T-1, it is more efficient for the purposes of this example to divide the superheater 50 into two sections, the one shown at 50 and a second one depicted in phantom at 48.

Case #1

A boiler and delivery system are operating at 85% efficiency supplied with boiler feedwater at a temperature of 310° F. and an enthalpy of 280.0 Btu per pound. The system converts 1,200,000 pounds per hour of the feed water to steam at 690° F. temperature and 550 psia (an enthalpy of 1349.0 Btu per pound) and delivers this steam to a process chamber. The thermal input required by the boiler is determined as follows:

| Base Case - Boiler Supplying Steam Without a Superposed Turbine |
|---|
| 1349.0 Btu/pound enthalpy to the process chamber |
| −280.0 Btu/pound enthalpy of boiler feedwater |
| 1069.0 Btu/pound of steam raised in boiler |
| X1,200,000 pounds/hour of steam to process |
| 1,282,800,000 Btu/hour heat added to water |
| ÷0.85 efficiency of boiler and delivery system |
| 1,509,176,471 Btu/hour heat added to the boiler |

EXAMPLE OF BASIC SUPERPOSED TURBINE (FIG. 1)

As in the base case, boiler 18 and its delivery system also operate at 85% efficiency and that is supplied by boiler feedpump 16 with boiler feedwater at 310° F. temperature and 280.0 Btu/pound enthalpy. The boiler 18 supplies steam to superposed turbine T at 950° F. temperature and 1450 psia pressure (an enthalpy of 1461.4 Btu/pound). The superposed turbine T operates at an efficiency of 90%, exhausting steam to the process chamber 12 at 690° F. and 550 psia, an enthalpy of 1349.0 Btu/pound. The thermal input to the boiler 18 is determined as follows:

| Thermal Input to Boiler 18 (FIG. 1) |
|---|
| 1461.4 Btu/pound enthalpy to superposed turbine T |
| −280.0 Btu/pound enthalpy of boiler feedwater 16 |
| 1181.4 Btu/pound of steam raised in boiler 18 |
| X1,200,000 pounds/hour of steam to superposed turbine T |
| 1,417,680,000 Btu/hour heat added to water |
| ÷0.85 efficiency of boiler 18 and delivery system |
| 1,667,858,824 Btu/hour heat added to the boiler 18 |

Work Done by Superposed Turbine T (FIG. 1)

In the process of expanding steam from 1450 psia and 950° F. to 550 psia and 690° F., the superposed turbine T accomplishes work as follows:

| |
|---|
| 1461.4 Btu/pound enthalpy to superposed turbine T |
| −1349.0 Btu/pound enthalpy leaving superposed turbine T for delivery to process chamber 12 |
| 112.4 Btu/pound work by superposed turbine T |
| X1,200,000 pounds/hour of steam to superposed turbine T |
| 134,880,000 Btu/hour of work by superposed turbine T |
| ÷3412.75 Btu/kw-hour: conversion factor |
| 39,522 kw work by superposed turbine T |

Economy of Superposed Turbine T (FIG. 1)

To determine the incremental thermal cost of the work of superposed turbine T, it is necessary to compare to the input required by the boiler operating without a superposed turbine.

| |
|---|
| 1,667,858,824 Btu/hour heat added to boiler 18 |
| −1,509,176,471 Btu/hour heat added to base case boiler |
| 158,682,353 Btu/hour additional heat to boiler 18 |
| ÷39,522 kw work by superposed turbine T. |
| 4,015 Btu/kw-hour |

EXAMPLE OF THIS INVENTION (FIG. 2)

Reboiler feed pump 44 supplies 1,200,000 pounds/-hour of water at 310° F. (and at an enthalpy of 280.0 Btu/pound) to the low pressure side 46 of the condensing reboiler, where it is raised to steam at 560 psia. The steam is then superheated in superheater 48 and superheater 50 for delivery to the low pressure steam process chamber 38 at 550 psia pressure and 690° F. temperature, an enthalpy of 1349.0 Btu/pound.

In this example, the condensing reboiler 46 and superheater 48 raise the steam to 560 psia and 540° F., an enthalpy of 1,253.1 Btu/pound. Following this the steam is conveyed to superheater 50 where its temperature is raised, and the steam is delivered to the low pressure process chamber at a pressure of 550 psia and a temperature of 690° F., an enthalpy of 1349.0 Btu/-pound.

Steam to turbine T-1 is at 2800 psia and 950 temperature, an enthalpy of 1411.2 Btu/pound. When this steam expands to 600 psia pressure at 90% turbine efficiency, it exhausts from turbine T-1 at 552° F., an enthalpy of 1257.2 Btu/pound. This steam enters superheater 48 and the condensing reboiler 36.

For this example, the steam flow to and from turbine T-1 is 1,500,000 pounds/hour, exhausting at 600 psia 552° F., an enthalpy of 1257.2 Btu/pound.

POWER GENERATION BY TURBINE T-1

Power generation by turbine T-1 can be determined as follows:

| | |
|---|---|
| Btu/pound of steam entering turbine T-1 | .1411.2 |
| less Btu/pound of steam exhausting from T-1 | −1257.2 |
| Energy converted to work in T-1, Btu/pound | 154.0 Btu/pound |
| Times steam flow through T-1, pounds/hour | X1,500,000 |
| Energy converted to work in T-1, Btu/hour | 231,000,000 |
| divided by constant 3412.75 Btu/kw hour | ÷3412.75 |
| Turbine work in kw | 67,687 kw |

HEAT ADDED FOR EXAMPLE CASE

Heat added for this example case can be determined as follows:

Heat to process chamber (flow times enthalpy) less heat contained in water at pump 44 (flow times enthalpy) represents the amount of heat this water has picked up in the condensing reboiler and superheaters 48 and 50. Adjusted for boiler efficiency, this provides a method to determine the heat input.

1,200,000 pounds/hour × (1349.0 − 280.0) Btu/pound = 1,282,800,000 Btu/hour (The same as for the previous two examples)

Of this, the portion picked up in superheater 50 is determined as follows:

| | |
|---|---|
| Enthalpy of steam at 550 psia 690° F. = | 1349.0 Btu/pound |
| less enthalpy of steam at 540° F. psia 560° F. = | 1253.1 Btu/pound |
| enthalpy pick up per pound in superheater 50 | 95.9 Btu/pound |
| times steam flow | X1,200,000 pounds/hour |
| | 115,080,000 Btu/hour |

The remainder, 1,167,720,000 Btu/hour represents the heat added by the condensing reboiler 46 and superheater 48.

Steam leaving turbine T-1 condenses in condensing reboiler 36 at a pressure of 600 psia. In the example herein discussed, this condensed steam can be sub-cooled below its saturation temperature of 486.20° F. to 482.4° F. in an optional sub-cooling zone of the condensing reboiler 36. This sub-cooled water can then be pumped by boiler feed pump 34 to boiler 30, where steam can be generated for delivery to turbine T-1.

THERMAL INPUT

The thermal input required by boiler 30 is determined as follows:

| | |
|---|---|
| Enthalpy of steam sent to turbine T-1, Btu/pound | 1411.2 |
| less enthalpy of water at pump 34, Btu/pound | −467.3 |
| Heat added in boiler 30, Btu/pound | 943.9 |
| Times flow through boiler, pounds/hour | X1,500,000 |
| Thermal output of boiler Btu/hour | 1,415,850,000 |
| Divided by boiler efficiency | ÷0.85 |
| Thermal input to boiler, Btu/hours | 1,665,705,882 |

The thermal input to superheater 50 may be from a number of sources. For this example, this superheater is fired separately in a configuration whose thermal efficiency is assumed to be 85%. Thermal input to the superheater will be the heat added to the steam by the superheater (115,080,000 Btu/hour) divided by 0.85, or 135,388,235 Btu/hour.

SYSTEM THERMAL INPUT

The system thermal input is the sum of inputs to boiler 30 (1,665,705,882 Btu/hour) and superheater 50 (135,388,235 Btu/hour), or a total system thermal input of 1,801,094,117 Btu/hour.

Figure 2:
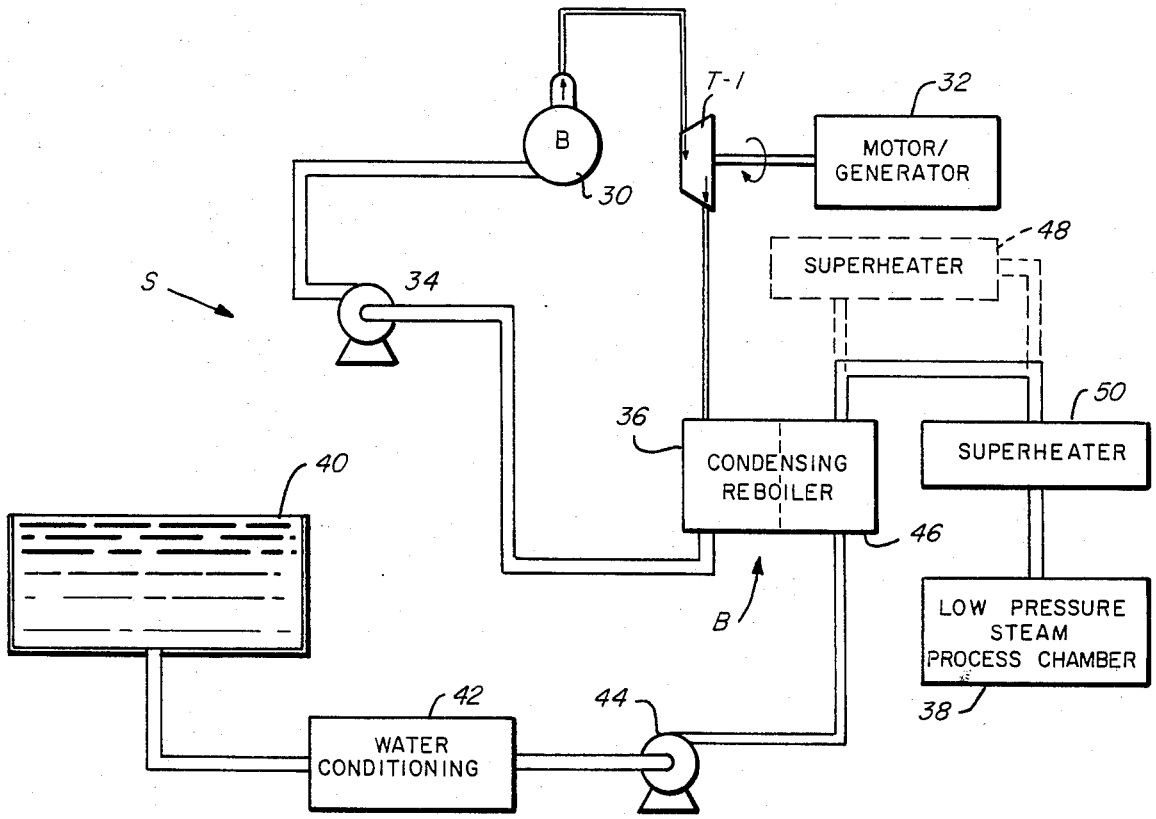
FIG. 2 is a schematic diagram of a steam supply system according to the present invention.

Economy of Superposed Turbine T-1 (FIG. 2)

The incremental thermal cost of the work of superposed turbine T-1 is determined by comparing to the input required by the boiler operating without a superposed turbine.

| | |
|---|---|
| 1,801,094,117 | Btu/hour system thermal input |
| −1,509,176,471 | Btu/hour heat added to base case boiler |
| 291,917,646 | Btu/hour additional system heat required |
| ÷67,687 | kw work by superposed turbine T-1 |
| 4,313 | Btu/kw-hour |

Discussion of Examples

The above examples cover three situations:

1. A boiler supplying steam to a process chamber.
2. A boiler supplying steam to a superposed turbine which exhausts to a process chamber.
3. A boiler supplying steam to a superposed turbine which exhausts to a condensing reboiler through an optional superheater; the condensing reboiler then provides steam through superheaters (when necessary) to a process chamber.

All examples are providing to the process chamber the same quantity of steam at the same pressure and temperature. In cases 1 and 2 above it is implicit that the process chamber receives essentially the same quantity of steam as is generated by the boiler, unless the excess steam is bypassed and wasted. In case 3, however, the quantity of steam flow from the boiler may differ from the steam flow to the process chamber, thus providing an extra increment of flexibility to the plant designer and operator.

The foregoing disclosure and description of the invention are illustrative and explanatory thereof, and various changes in the size, shape and materials, as well as in the details of the illustrated construction may be made without departing from the spirit of the invention.

What is claimed is:

1. A steam supply system for a process chamber consuming superheated steam at a pressure of about 600 psi or below which is driven by a boiler operating at a pressure of about 2000 psi, a pressure range above that needed by said process chamber for also driving a superposed turbine, comprising:

(a) a high pressure boiler feed pump for supplying highly purified water to said boiler;

(b) a condensing reboiler connected to receive steam from said superposed turbine in a high pressure side;

(c) said condensing reboiler also having a low pressure side, essentially isolated from fluid contact with said high pressure side, for receiving water for use in the lower operating pressure steam processes;

(d) said condensing reboiler further comprising integral superheating means for heating the wster received in said low pressure side into superheated low pressure steam with the steam received in the high pressure side;

(e) means for conveying fluid from said high pressure side of said condensing reboiler to said boiler feed pump; and (f) means for conveying the low pressure superheated steam from said condensing reboiler to said process chamber.

2. The apparatus of claim 1, wherein said process chamber comprises means for gasification of carbonaceous fuel.

3. The apparatus of claim 1, further including:

means for at least partially purifying the water to be received in said low pressure side of said condensing reboiler.

4. The apparatus of claim 3, wherein said purifying means includes:

water softening means.

5. The apparatus of claim 3, wherein said purifying means includes:

water demineralizer means.

6. The apparatus of claim 1, further including:

pump means for supplying water to said low pressure side of said condensing reboiler.

7. The apparatus of claim 1, wherein:

said feed pump, said boiler, said turbine and said high pressure side of said condensing reboiler are connected in a closed loop fluid flow path.

8. A process of supplying superheated steam for a process chamber consuming steam at a pressure of about 600 psi or below which is driven by a boiler operating at a pressure range above that needed by the process chamber for also driving a superposed turbine with steam at a pressure of 2000 psi or above, comprising the steps of:

(a) supplying highly purified water to the boiler;

(b) receiving steam from the superposed turbine in a high pressure side of a condensing reboiler;

(c) receiving water in a low pressure side of the condensing reboiler having an integral superheater in fluid isolation from the high pressure side;

(d) heating the water in the low pressure side, with the steam received from the superposed turbine, into low pressure superheated steam;

(e) conveying fluid from the high pressure side of the condensing reboiler for supply to the boiler; and (f) conveying low pressure superheated steam to the process chamber for use therein.

9. The method of claim 8, wherein:

the steam consuming process is gasification of carbonaceous fuel; and the useful work performed by the turbine is power generation.

10. The method of claim 9, further comprising the step of:

demineralizing the water before passing the water to the low pressure side of the condensing reboiler.

* * * * *

UNITED STATES PATENT AND TRADEMARK OFFICE

CERTIFICATE OF CORRECTION

PATENT NO. : 4,608,058

DATED : August 26, 1986

INVENTOR(S) : William M. Menger

It is certified that error appears in the above-identified patent and that said Letters Patent is hereby corrected as shown below:

In the title, please delete TURINE and insert --TURBINE--.

In column7, line 66, delete"540°F" and insert --560--.

In column 7, line 67, delete "560°" and insert --540°--.

In column 9, line 35, delete "wster" and insert --water--.

Signed and Sealed this

Thirtieth Day of December, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,608,058

DATED : August 26, 1986

INVENTOR(S) : William M. Menger

It is certified that error appears in the above-identified patent and that said Letters Patent is hereby corrected as shown below:

In column 5, line 56, delete "4017" and insert --4313--.

Signed and Sealed this

Twenty-eighth Day of April, 1987

*Attest:*

DONALD J. QUIGG

*Attesting Officer*

*Commissioner of Patents and Trademarks*